US005150874A

United States Patent [19]

Spiegel et al.

[11] Patent Number: 5,150,874

[45] Date of Patent: Sep. 29, 1992

[54] APPARATUS FOR MOUNTING FOLDABLE BRANCHES TO AN ARTIFICIAL TREE

[75] Inventors: Si Spiegel, Briar Cliff Manor; Sherman Smith, Newburgh, both of N.Y.

[73] Assignee: Hudson Valley Tree, Inc., Newburgh, N.Y.

[21] Appl. No.: 499,614

[22] Filed: Mar. 26, 1990

[51] Int. Cl.[5] ..... A47G 33/00

[52] U.S. Cl. ..... 248/514; 211/205; 428/8; 428/20

[58] Field of Search ..... 248/514, 538; 211/205; 428/7, 8, 9, 18, 19, 20

[56] References Cited

U.S. PATENT DOCUMENTS

| | | | |
|---|---|---|---|
| 3,115,435 | 12/1963 | Abramson | 428/8 |
| 3,131,112 | 4/1964 | Abramson . | |
| 4,248,916 | 2/1981 | Chase . | |
| 4,291,075 | 9/1981 | Puleo | 211/205 |
| 4,343,842 | 8/1982 | Chase | 428/8 |
| 4,897,292 | 1/1990 | Glickman | 428/8 |

*Primary Examiner*—David L. Talbott
*Attorney, Agent, or Firm*—Hopgood, Calimafde, Kalil, Blaustein & Judlowe

[57] ABSTRACT

An improved apparatus for mounting artificial tree branches to an artificial tree trunk. A series of bracket guideways, each bridged by a horizontal pin, are adapted for pivotal engagement each with a branch member for movement between stowed and operative positions. Each branch mounts a hinge piece adjacent to one end adapted for pivotal engagement with the horizontal pin as the branch moves between stowed and operative positions, the hinge piece suspending the branch radially from the tree trunk when in an operative position. Snaps secure the branch in a groove on the hinge piece to restrict movement of the branch about the bracket when in either a stowed or an operative position. Extended bracket guideways and a hinge piece back stop also assist in securing the branch to the hinge piece and restricting radial movement of the branch about the bracket.

22 Claims, 1 Drawing Sheet

APPARATUS FOR MOUNTING FOLDABLE BRANCHES TO AN ARTIFICIAL TREE

BACKGROUND AND SUMMARY OF INVENTION

This invention relates to apparatus for mounting foldable artificial tree branches to an artificial tree trunk.

Artificial trees are generally comprised of a long pole or artificial tree trunk having branch members mounted radially along the length thereof to simulate the appearance of a live tree. These branch members are detachably mounted to brackets affixed to the artificial tree trunk to facilitate removal of the branches and storage of the artificial tree. Although the branch members may be readily mounted to and removed from the artificial tree trunk, the annual task of assembling or disassembling an artificial tree having a multitude of branches is a monotonous and time consuming task. Another disadvantage of conventional artificial trees is that separation of the branch members from the tree trunk increases the likelihood of loss of or damage to the branches.

Other artificial trees have branch mounting brackets which affixedly mount branch members for movement between retracted and extended positions. However, the mechanisms for securing these branches in either position often fail causing the branch to flop about the bracket and rotate radially. As a consequence, transporting the tree becomes difficult even when the branches are in the retracted position. In addition, the conventional wire branch construction of artificial tree branches is very susceptible to bending or even breakage. When in the extended position, a broken or uneven branch detracts from the full appearance of the tree. Furthermore, stronger bracket designs have been found costly to manufacture.

Still other tree brackets utilize passageways for guiding the branch members upon movement between the retracted and extended positions. Yet, such passageways are burdensome requiring continuous adjustment of the branch member in order to move it through the passageway. A bracket assembly of this general configuration is disclosed, for example, in a co-pending application of the present assignee, Ser. No. 378,371, filed Jul. 11, 1989, entitled "BRACKET FOR MOUNTING FOLDABLE BRANCHES TO AN ARTIFICIAL TREE", disclosures of which are hereby incorporated by reference.

A few additional prior artificial tree structures are shown, for example, in U.S. Pat. Nos. 3,115,435 issued to Abramson, 3,131,112 issued to Abramson, 4,248,916 issued to Chase and 4,343,842 issued to Chase.

Accordingly, it is desirable that artificial trees be stored without disassembly of the branch members from the tree trunk. It is also desirable that the branch members be suitably constructed and mounted to the artificial tree trunk in a manner which prevents radial rotation or bending of the members in either the retracted or extended position. In addition, it is desirable that the branch mounting brackets have reliable means for moving the branches between extended and retracted positions and for suspending the branches in the extended position. It is further desirable that the branch members be simple to move between the extended and retracted positions. Finally, it is desirable that the branch mounting brackets be inexpensive to manufacture.

The present invention is directed to an improved artificial tree bracket assembly including a hinge mechanism for mounting artificial tree branches to an artificial tree trunk. A series of bracket guideways each mount a pin which facilitates pivotal movement of a branch member between stowed and operative positions. Each branch mounts a hinge piece adjacent to one end, the hinge piece being adapted for pivotal engagement with the guideway pin so as to suspend the branch in the operative position radially from the tree trunk. As each branch member moves between the stowed and operative positions, its corresponding hinge piece pivots about the respective guideway pin. Upon moving the branch to a stowed position, the hinge piece moves between the guideway inner walls while pivoting about the pin. In the operative position, side portions of each guideway cooperate with the hinge piece so as to restrict rotation of the branches about the bracket.

Accordingly, it is an object of this invention to provide an improved apparatus for mounting foldable artificial tree branches to an artificial tree trunk.

It is a further object of this invention to provide a reliable bracket for the one-time mounting of foldable branches to an artificial tree trunk.

It is another object of this invention to provide an economical artificial tree branch mounting bracket which simplifies the set-up of artificial trees.

It is still a further object of this invention to provide an artificial tree branch mounting bracket which enables quick and easy storage of artificial trees.

It is also an object of this invention to provide a novel means for releasably securing foldable branches to an artificial tree as an optional method of tree storage.

BRIEF DESCRIPTION OF THE DRAWINGS

For a better understanding of this invention, reference is made to the following drawings which are to be taken in conjunction with the detailed description to follow.

DESCRIPTION OF THE PREFERRED EMBODIMENT

The present invention relates to a fold-up artificial tree bracket hinge assembly 10 for mounting artificial tree branches to an artificial tree, for example, an artificial Christmas tree, and moving the branches between stowed and operative positions; the assembly comprising branch members 30, each having a hinge piece 20 adapted for pivotal movement with respect to the bracket, the hinge piece suspending the branch members radially from the bracket in the operative position, means for guiding each hinge piece as it pivots between the stowed and operative positions, and securing means for fastening the branch member to the hinge piece, thereby restricting movement of the members about the bracket when in either of the stowed or operative positions.

Figure 1:
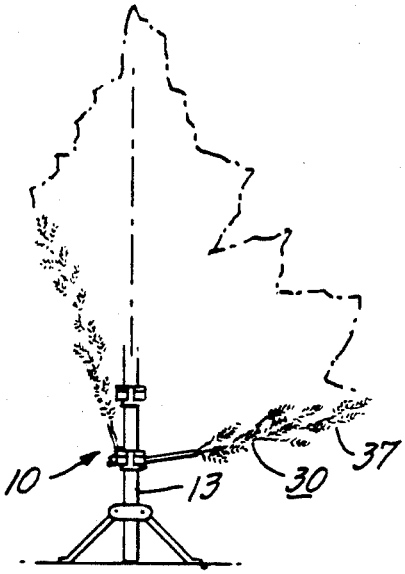
FIG. 1 is a side view of the bracket of the present invention mounted to an artificial tree trunk.
Figure 2:
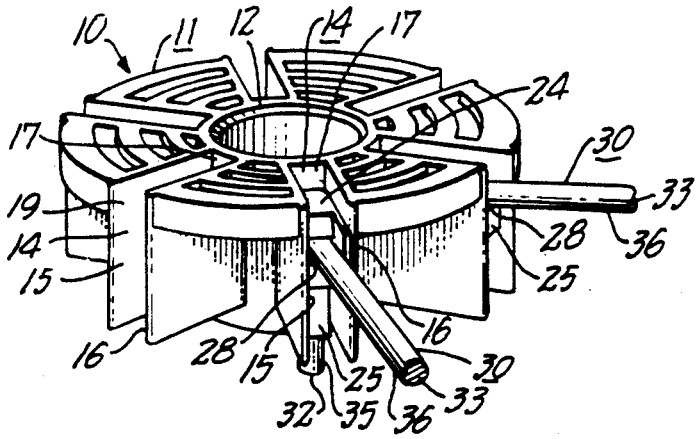
FIG. 2 is a perspective view of the major components of the bracket assembly of the present invention.

More specifically, FIG. 2 illustrates an improved bracket 10 for mounting retractable artificial branches to an artificial tree trunk constructed in accordance with the present invention. The bracket structure 11 has an annular shape with a hole 12 through its center for receiving a pole or an artificial tree trunk 13, as shown in FIG. 1, and to facilitate the selective positioning of the bracket at intervals along the length of the trunk. At the factory, each bracket is moved to a preselected position on the tree trunk and is then secured thereto using suitable fasteners.

Referring again to FIG. 2, the bracket structure also includes a series of guideways or channels 14 spaced at intervals along the peripheral edge of its annular structure for receiving branch members or artificial tree branches 30. Each channel 14 comprises a pair of opposing parallel walls 15 and 16 bounded along corresponding edges by an innermost wall or channel bottom 17 to define a generally rectangular channel.

Although the present invention has been described as having six channels, it is understood that any number of channels (though preferably three or more) may be used depending upon the appearance of fullness desired. For example, eight channels may be used to simulate the appearance of a live tree having thick growth.

Figure 4:
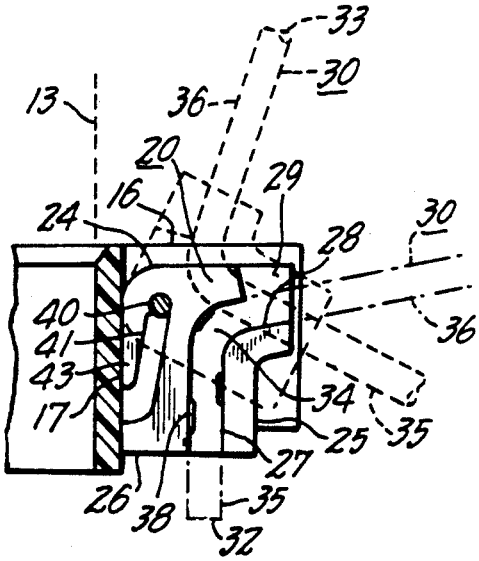
FIG. 4 is a sectional view taken along line 4—4 of FIG. 3 showing a branch in the stowed and operative positions.

As best seen in FIG. 4, each branch 30 comprises a rod having a bend, for example approximately 90 degrees, between its first and second ends, 32 and 33 respectively. The bend is proximate to first end 32 and forms an elbow 34. The elbow divides the branch into a first or shorter leg 35 and a second or longer leg 36. Longer leg 36 mounts supporting surfaces such as soft or hard bristles 37 thereon to simulate the appearance of a living tree branch, as shown in FIG. 1. This branch structure facilitates maximum support of the artificial tree branch when suspended in the operative position.

Although the elbow is depicted in the drawings as having a bend of approximately 90 degrees, it is understood that the angle formed at the elbow may be varied so as to achieve any desired appearance of the tree; provided, however that heavy duty branch construction is used so that firm support of the branch is provided at any selected angle. It is understood that heavy duty branch construction may be achieved, for example, by a single rod or more than two wires or rods twisted together.

Figure 5:
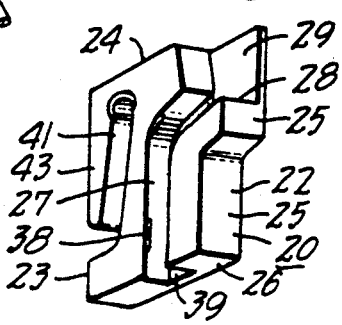
FIG. 5 is a perspective view of the pivotal hinge piece of the present invention.
Figure 6:
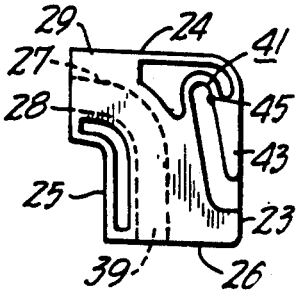
FIG. 6 is a rear side view of the hinge piece of FIG. 5.

As best seen in FIGS. 5 and 6, each hinge piece 20 includes front and rear surfaces 21, 22 having side walls 23, 24, 25, 26 mounted between and generally perpendicular to the surfaces so as to form a generally rectangular structure. An L-shaped groove 27 formed in front surface 21 is suitably configured for receiving the branch member elbow and shorter leg to anchor the branch member to the hinge piece. A cut away portion at the top end of the groove forms a ledge 28 proximate to wall 25 for supporting the branch member longer leg upon radial suspension from the bracket. The cut away portion also forms a wall rest or back stop 29 for restricting radial backwards rotation of the branch member about the bracket assembly and for strengthening ledge 28 to support the branch member. The bottom end of the groove communicates with an opening 39 in wall 26 to permit the branch shorter leg to protrude from the hinge piece.

Snaps 38 along the side edges of the groove engage the elbow and shorter leg for securing the branch member to the hinge piece upon assembly of the tree, as best seen in FIG. 4.

Figure 3:
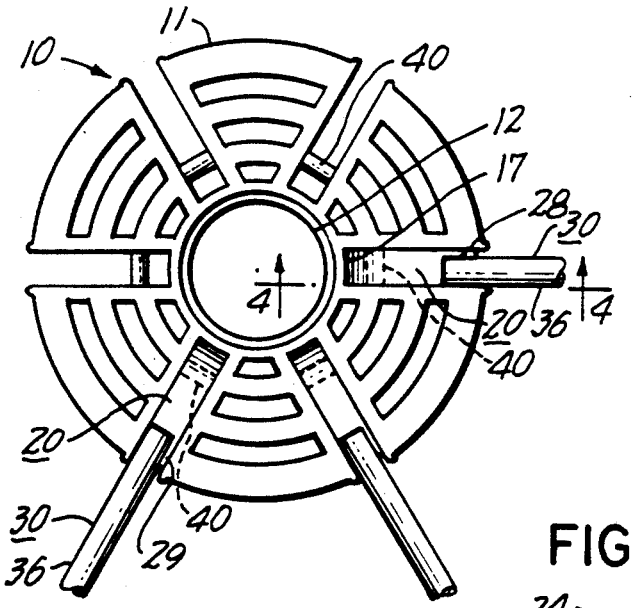
FIG. 3 is a top view of the apparatus of FIG. 2.

As shown in FIGS. 3 and 4, a pin 40 is mounted between walls 15 (not shown in FIG. 4) and 16 at the channel upper rear portion 19 so as to bridge the channel. The pin, for example, may be formed as a molded plastic piece between the channel walls. This one piece molded construction of the bracket and pin assembly has been found inexpensive to manufacture.

A hook 41 formed in the upper portion of hinge piece wall 23 has a hook snap 45 for snappingly receiving the pin so as to allow pivotal movement of the hinge piece about the pin and the suspension of the branch member from the bracket assembly. The hook also has a finger portion 43 extending downwardly therefrom for guiding the pin into the hook snap. The finger portion has a length suitable for preventing slippage of the pin from the hook, should the pin become unsnapped. Upon snapping the branch member elbow into the hinge piece groove and the hook onto the pin, the branch member may pivot freely about the pin between stowed and operative positions. In this manner, the branch is prevented from swinging about or from being off-center and creating bare spots in the tree, as best seen in FIG. 3.

The branch member may also be unsnapped from the hook as an alternative to fold-up storage of the artificial tree. Therefore, this novel bracket assembly permits either fold-up or disassembly as options for storage of the artificial tree.

Upon contact of hinge wall 23 with a first contact surface of channel innermost wall 17 and the simultaneous engagement of the hook with the pin, the branch member is suspended radially from the bracket in a generally horizontal or operative position, as shown in FIG. 4 by semi-solid lines. The member may also be rotated counterclockwise about its hinge piece until the member is in a generally vertical or stowed position, as shown in FIG. 4 by dashed lines. In this position, the pin engages the hook so as to vertically support the branch member, the hinge wall 24 resting against a second contact surface of channel bottom 17 for horizontal support. In either position, channel walls 15, 16 assist back stop 29 in restricting radial rotation of the branch member about the bracket.

The hook is formed at a suitable location on the hinge piece and the hinge piece is suitably configured (the corner between hinge piece walls 23 and 24 being curved for clearing the innermost wall of the channel) so as to permit pivotal movement of the hinge piece within the channel while minimizing slippage of the pin from the hook. Also, the channel has a suitable length to provide the contact surface necessary for engaging the hinge piece wall 23 and suspending the branch member in the operative position. The channel width and depth are sufficient to guide the hinge piece as it pivots through the channel while restricting radial movement of the branch member about the bracket assembly.

Referring now to FIG. 4, in operation, beginning from the stowed or vertical position where the branches are generally parallel to artificial tree trunk 13, each branch must be rotated about its corresponding hinge piece in a generally clockwise fashion to place the branches in the operative position. As each branch moves toward the operative position, the hinge piece hook pivots about the pin until wall 23 abuts face-to-face with the innermost channel wall, the branch member being in the operative position.

For retracting the branches for storage of the tree, the branches must be moved counterclockwise toward the vertical or stowed position. Upon counterclockwise movement, the hinge piece hook pivots about its pin longer leg; again, the configuration of the hinge piece permitting it to clear the innermost wall of the channel. When the branch longer leg attains a position generally parallel with the tree trunk, it is in the stowed position; the longer leg resting against the upper vertical surfaces, for example, an artificial tree trunk or upper branches, for support in the vertical position.

When the branches are in either the stowed or the operative position, the engagement of the elbow with the groove in each hinge piece prevents the branch from sliding downward through the channel or from rotating radially about the bracket.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A bracket assembly for mounting foldable artificial tree branches to an artificial tree trunk comprising:

at least one branch member having an elbow adapted for pivotal engagement with said bracket upon movement of said member between a stowed and an operative position;

a hinge piece for mounting said member to said bracket for pivotal movement between the stowed and operative positions, said hinge piece haivng a bottom surface, and an open-sided groove extending downwardly and terminating proximate to said surface for snap fit reception of said member so as to suspend said member radially from said bracket in said operative position;

snaps along said groove for securing said member in said groove so as to limit movement of said member about said bracket when in the stowed and operative positions; and means for guiding said hinge piece upon movement of said member between the stowed and operative positions, said guiding means restricting movement of said member about said bracket when in the stowed and operative positions while assisting in securing said member to said hinge piece.

2. The bracket assembly set forth in claim 1 wherein said elbow includes a first leg and a second leg, said first leg mounting said hinge piece and said second leg mounting bristles.

3. The bracket set forth in claim 2 wherein said guiding means includes a channel adapted for receiving said hinge piece upon pivotal movement of said member between stowed and operative positions, said channel having a selected depth to assist in the engagement of said elbow with said groove.

4. The bracket set forth in claim 3 wherein said mounting means further includes a pin bridging said channel, said hinge piece being adapted for receiving said pin for pivotal engagement therewith upon pivotal movement of said branch member between stowed and operative positions.

5. A fold up artificial tree assembly for mounting artificial tree branches, comprising:

a tree trunk, at least one branch member, and bracket means for supporting each of said branch members in a stowed and an operative position, said branch member having a branch end and a branch leg forming an angled elbow, said branch leg supporting branch pieces, said branch member also having hinge means to engage said bracket means for pivotal movement of said branch member between stowed and operative positions, said bracket means having channel means for receiving said hinge means to guide said hinge means as said branch member pivots between the stowed and operative positions, said hinge means having a bottom surface, and an open-sided groove extending downwardly and terminating poximate to said surface for receiving and supporting said branch member upon engagement with said bracket means thereby suspending said branch member from said artificial tree assembly in the operative position, and said groove having snap means to limit movement of said branch member relative to said bracket means and assist in supporting said branch member, said channel means assisting in securing said branch member to said hinge means.

6. The tree assembly of claim 5 in which said channel means includes a first surface to limit downward movement, but to allow pivoting movements, and a second surface to limit upward movement.

7. The tree assembly of claim 6 in which said channel means further includes pin means, said hinge means being adapted for receiving said pin for pivotal engagement therewith upon movement of the branch member between stowed and operative positions.

8. A bracket assembly for mounting foldable artificial tree branches to an artificial tree trunk comprising:

at least one branch member having an elbow adapted for pivotal engagement with said bracket upon omvement of said member between a stowed and an operative position;

means for mounting said branch member to said bracket for pivotal engagement therewith upon movement between the stowed and operative positions, whereupon said mounting means suspends said branch member radially from said bracket in the operative position;

said mounting means having a hinge piece associated with said member and adapted for pivotal engagement with said bracket upon movement of said member between stowed and operative positions;

said hinge piece having a bottom surface, and an open-sided groove extending downwardly and terminating proximate to said surface for receiving said branch member so as to suspend said member radially from said bracket in the operative position;

snaps in said groove for securing said member to said hinge piece so as to limit movement of said member about said bracket when in the stowed and operative positions;

means for guiding said hinge piece upon movement of said member between the stowed and operative positions, said guiding means restricting movement of said member about said bracket when in the stowed and operative positions while assisting in securing said member to said hinge piece.

9. The bracket assembly set forth in claim 8, wherein said elbow includes a first leg and a second leg, said first leg mounting said hinge piece and said second leg mounting bristles.

10. The bracket set forth in claim 9 wherein said guiding means includes a channel adapted for receiving said hinge piece upon pivotal movement of said member between stowed and operative positions, said channel having a selected depth to assist in the engagement of said elbow with said groove.

11. The bracket set forth in claim 10 wherein said mounting means furthe rincludes a pinb ridging said channel, said hinge piece being adapted for receiving said pin for pivotal engagement therewith upon pivotal movement of said branch member between stowed and operative positions.

12. A bracket assembly for mounting foldable artificial tree branches to an artificial tree trunk comprising:

at least one branch member having an elbow adapted for pivotal engagement with said bracket upon movement of said member between a stowed and an operative position;

means for mounting said branch member to said bracket for pivotal engagement therewith upon movement between the stowed and operative positions, whereupon said mounting means suspends said branch member radially from said bracket in the operative position;

means for securing said member to said mounting means so as to limit movement of said member about said bracket when in the stowed and operative positions; and means for guiding said mounting means upon movement of said member between the stowed and operative positions, said mounting means having a bottom surface, and an open-sided L-shaped groove extending downwardly and terminating proximate to said surface adapted to engage said member elbow, said guiding means restricting disengagement of said member from said groove upon securing said member to said mounting means and suspending said member radially from said bracket in the operative position.

13. A bracket assembly for mounting foldable artificial tree branches to an artificial tree trunk comprising:

at least one branch member having an elbow adapted for pivotal engagement with said bracket upon movement of said member between a stowed and an operative position;

hinge means for mounting said branch member to said bracket for pivotal movement between the stowed and operative positions, said hinge means having a bottom surface, and an open-sided groove extending downwardly and terminating proximate to said surface for snap fit reception of said branch member;

snap means along said groove for securing said member in said groove; and guide means having a series of spaced apart, radially extending walls defining radial channels for receiving said hinge means upon its movement between the stowed and operative positions.

14. The bracket assembly set forth in claim 13 wherein said elbow includes a first leg and a second leg, said first leg mounting said hinge means and said second leg mounting bristles.

15. The bracket assembly set forth in claim 13 wherein said channel has a selected depth to assist in the engagement of said elbow with said groove.

16. The bracket assembly set forth in cliam 13 wherein the hinge means has a curved corner for clearance of an innermost wall of said channel upon pivotal movement of said hinge means between said channel walls.

17. The bracket assembly set forth in claim 16 wherein, as each branch member moves toward the operative position, said hinge means pivots about a pin which extends between said channel walls until an innermost hinge piece wall abuts face-to-face with said innermost channel wall, said branch member being in the operative position.

18. A bracket assembly for mounting foldable artificial tree branches to an artificial tree trunk comprising:

at least one branch member having an elbow adapted for pivotal engagement with said bracket upon movement of said member between a stowed and an operative position;

a hinge piece for mounting said branch member to said bracket for pivotal movement between the stowed and operative positions, said hinge piece having a bottom surface, and a single open-sided groove extending downwardly and terminating proximate to said surface for snap fit reception of said branch member;

snaps along said groove for securing said member in said groove; and a series of spaced apart, radially extending walls defining radial channels for pivotal movement of said hinge piece between said channel walls.

19. The bracket assembly set forth in claim 18 wherein said elbow includes a first leg and a second leg, said first leg mounting said hinge piece and said second leg mounting bristles.

20. The bracket assembly set forth in claim 18 wherein each of said channels has a selected depth to assist in the engagment of said elbow with said groove.

21. The bracket assembly set forth in claim 18 wherein said hinge piece has a curved corner for clearance of an innermost wall of said channel upon pivotal movement of said hinge piece between said channel walls.

22. The bracket assembly set forth in claim 21, wherein each channel includes a pin extending between said walls thereof, said hinge piece pivotally engaging said pin as each branch member moves toward the operative position until said hinge piece abuts face-to-face with said innermost channel wall, said branch member being in the operative position.

* * * * *